United States Patent [19]

McNamara

[11] Patent Number: 4,592,105

[45] Date of Patent: Jun. 3, 1986

[54] BED FRAME CONSTRUCTION

[75] Inventor: George E. McNamara, Minneapolis, Minn.

[73] Assignee: Sico Incorporated, Minneapolis, Minn.

[21] Appl. No.: 580,001

[22] Filed: Feb. 14, 1984

[51] Int. Cl.[4] ..... A47C 23/06

[52] U.S. Cl. ..... 5/238; 5/236 R

[58] Field of Search ..... 5/238, 237, 236 R, 236 B, 5/191, 305

[56] References Cited

U.S. PATENT DOCUMENTS

| | | | |
|---|---|---|---|
| 663,774 | 12/1900 | McCourt | 5/238 |
| 2,983,931 | 5/1961 | Nelson | 5/238 |

FOREIGN PATENT DOCUMENTS

| | | | |
|---|---|---|---|
| 2005461 | 8/1971 | Fed. Rep. of Germany | 5/191 |
| 17390 | 8/1913 | France | 5/237 |
| 1460567 | 1/1977 | United Kingdom | 5/191 |

*Primary Examiner*—Alexander Grosz

*Attorney, Agent, or Firm*—Merchant, Gould, Smith, Edell, Welter & Schmidt

[57] ABSTRACT

A bed frame includes special structures for supporting and holding the bed slats in the required spacing. The side frame members of the bed frame each have elongate flange members which project from the side frame member inwardly of the bed and extend substantially the length of the bed and support the ends of the bed slats. A spacer strip having alternate tab and space portions fits across the slats with its space portions receiving the slats and its tab portions fitting between adjacent slats to secure them in the desired spaced relation.

3 Claims, 7 Drawing Figures

BED FRAME CONSTRUCTION

FIELD OF THE INVENTION

This invention relates to the manufacture of beds, and in particular to bed frames or support structures for supporting the mattress of the bed.

BACKGROUND OF THE PRIOR ART

A commonly used type of bed construction consists of a generally rectangular perimeter frame and support means for holding the mattress and other bedding. Typically the frame consists of metal or wood rails or beams joined together, sometimes with a headboard, legs, etc., and sized according to the desired bed size. The mattress is supported on the frame by a plurality of supports, commonly referred to as bed slats, which extend transversely across the frame at spaced intervals. Typically the side frame members of the bed frame have an inwardly extending flange along their lower edge, and the slats are cut to length to fit between the two side frame members of the bed and to be supported by the flange portions thereof. The mattress is then laid down across the slats and is supported thereby.

In some beds using a frame and support slats for the mattress, no fastening or spacing means are provided for the slats, other than the fact that the weight of the mattress in contact with the slats tends to hold them in position under normal circumstances. However, movement of the bed or mattress, for example in changing of the bedding or the like, can cause shifting of the slats along the flanges of the frame side members, resulting in bunching of some slats together with corresponding gaps in support for the mattress in other areas, or if the slats are allowed to move crosswide they may fall from the frame. For this reason holders or spacers are often provided for holding the slats in the desired spacing.

In the case of folding beds the opportunity for unwanted slat movement is of course much greater, and it is generally necessary to provide some sort of holding or spacing mechanism for the slats. Some types of holders used on non-folding beds may be inadequate to hold the slats in the case of a folding wall bed, wherein the bed is folded vertical against the wall in its storage position. In addition to providing positive and secure location and support for the slats, a slat support system should also be simple and economical to manufacture and assemble, and should permit easy disassembly and reassembly in the home or other use location in order to replace slats if necessary.

SUMMARY OF THE INVENTION

These and other features are provided by the present invention which provides an improved bed frame and slat holder assembly. According to the present invention there is provided an improved bed frame construction including a pair of spaced apart side frame members as part of a support frame which may also include end members or a headboard or the like connecting the side frame members to form a support frame. The side frame members each have a flange member projecting from the side frame members on the side thereof towards the middle of the bed and extend for some distance along the length of the side frame members. A plurality of bed slats are provided each having a length for fitting between the side frame members so that their ends are supported on the flanges, so that the slats can support a mattress or other bedding for the bed. Spacer strips are provided for said side frame members, the spacer strips having a plurality of tab portions alternating with space portions which correspond in width to the ends of the slats. Means are provided for securing the spacer strips across the ends of the slats with the tab portions extending between adjacent slats and with the space portions of the spacer strips receiving the slats, so as to secure the slats in the desired spaced relationship.

According to a preferred form of the invention, each of the side frame members may have a pair of parallel flange members spaced apart from one another to form a slot to receive and support the needs of the slats. The spacer strips are adapted to be secured with their tab portions extending across the slot and between adjacent slats to secure them in the desired space relationship. In a preferred embodiment, the parallel flange members may be formed from a U-sectioned channel member secured by its base to the side frame members, with its side portions forming the flanges defining the slot to receive the slats.

According to a preferred form of the invention, the spacer strips can be formed from an L-sectioned strip having a strip portion secured to one of the top or bottom flange portions, and the other strip portion of the L-sectioned spacer having alternate cutouts for receiving the spaced slats with the tab portions formed between adjacent cutouts projecting between slats to secure them in the desired spaced relationship.

DETAILED DESCRIPTION OF THE PREFERRED EMBODIMENT

Figure 1:
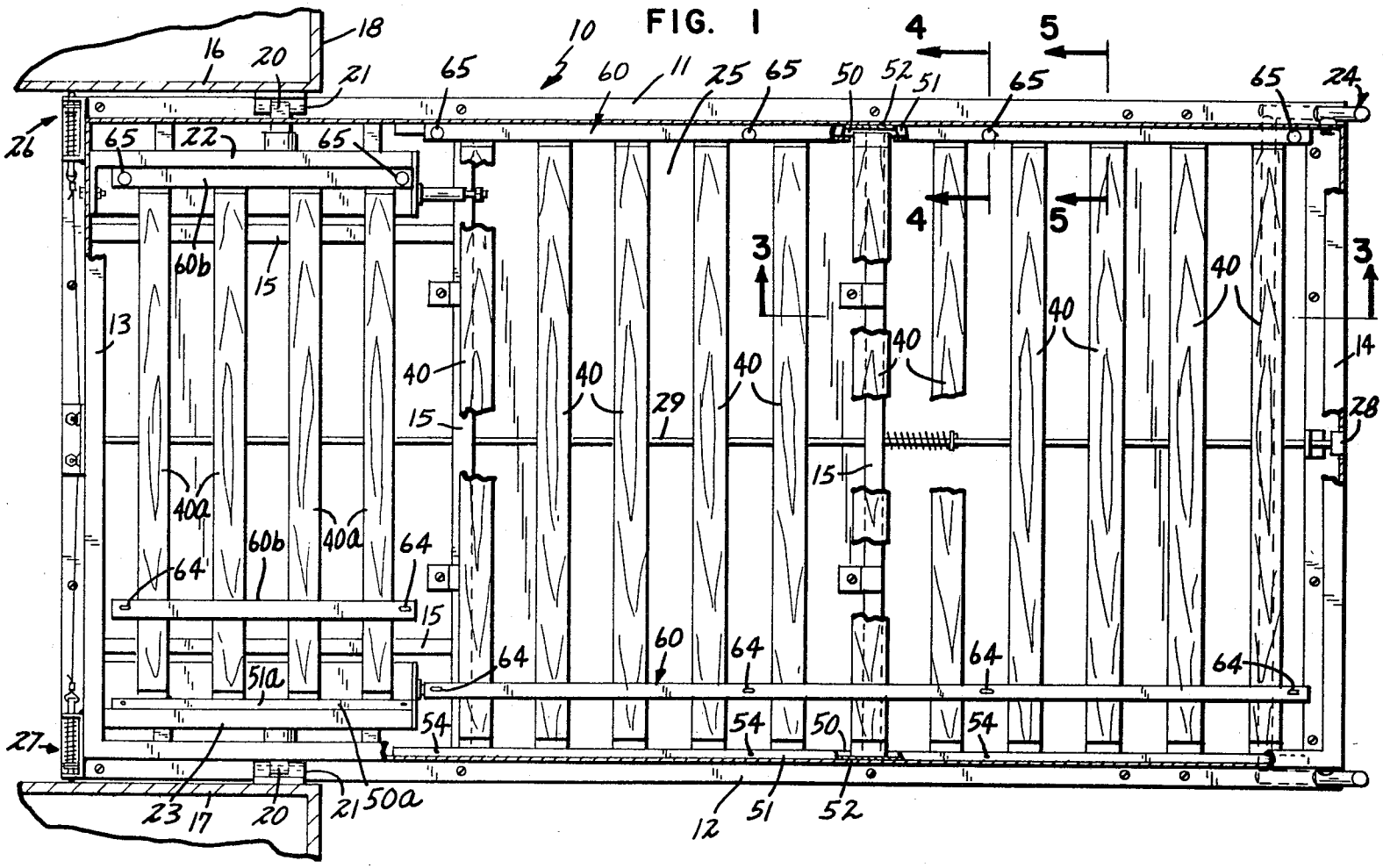
FIG. 1 is a plan view of a folding wall bed which incorporates the slat holding and spacing features of the present invention.
Figure 2:
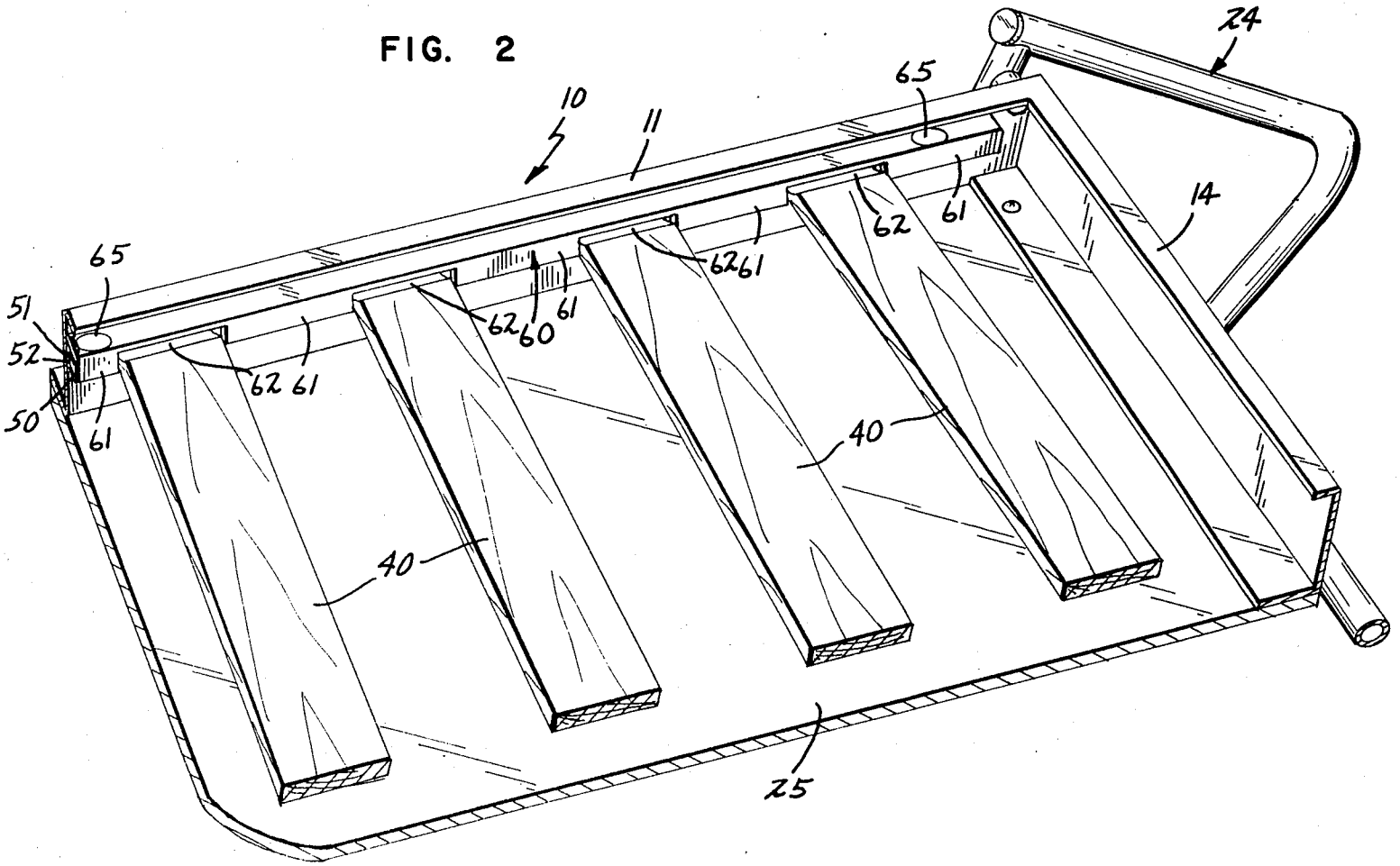
FIG. 2 is a view in perspective of a portion of the corner of the bed of FIG. 1.

The preferred form of the invention is illustrated herein as applied to a folding wall bed, but it will be appreciated that the invention is also applicable to other types of beds, whether folding, non-folding, movable or stationary. With reference to the drawing figures, in which the same reference numerals are used throughout for the same parts, the folding wall bed includes a support frame 10 which includes side frame members 11 and 12 and end members 13 and 14, which are all connected together as by welding to form a rectangular perimeter frame. The side and end frame members can be of wood or metal or any other suitable material, and in the preferred embodiment are in the form of steel beam type members which are welded together at their ends to form the corners of the support frame. End frame members 13 and 14 could also be part of a headboard or footboard as is generally known. If desired, suitable braces 15 can be provided attached to the frame members for strengthening the frame or supporting specific components thereof.

The folding wall bed of the preferred embodiment is adapted to be mounted in a recess in a cabinet or wall 18, and specifically between spaced apart side walls 16 and 17 of the recess. Pivots 20 are provided at either side of the frame and engage suitable sockets 21 mounted to the side walls 16, 17 to pivotally support the bed frame. Although any type of pivot or hinge mechanism can be used, the preferred embodiment is shown using hinge and counterbalance mechanisms 22, 23 of the type disclosed in U.S. Pat. No. 4,058,861. The housings for hinge and counterbalance mechanisms 22 and 23 are bolted or otherwise secured to the frame, so that the entire frame can fold up into the recess by pivoting about pivots 20. If desired, a latch system including pin type latches 26 and 27 and control button 28 and push rod 29 can be provided for preventing unintentional fold up of the bed. A folding leg assembly 24 can be provided as is generally known in folding beds, to support the end of the bed in the use position. A decorative panel 25 can be provided, attached by suitable means to the bottom of the support frame to form an attractive cover for the bed and recess when the bed is in the vertical storage position. Flanges can be provided on the side and end frame members to provide an attachment place for panel 25.

Figures 3, 4, 5, 6, 7:
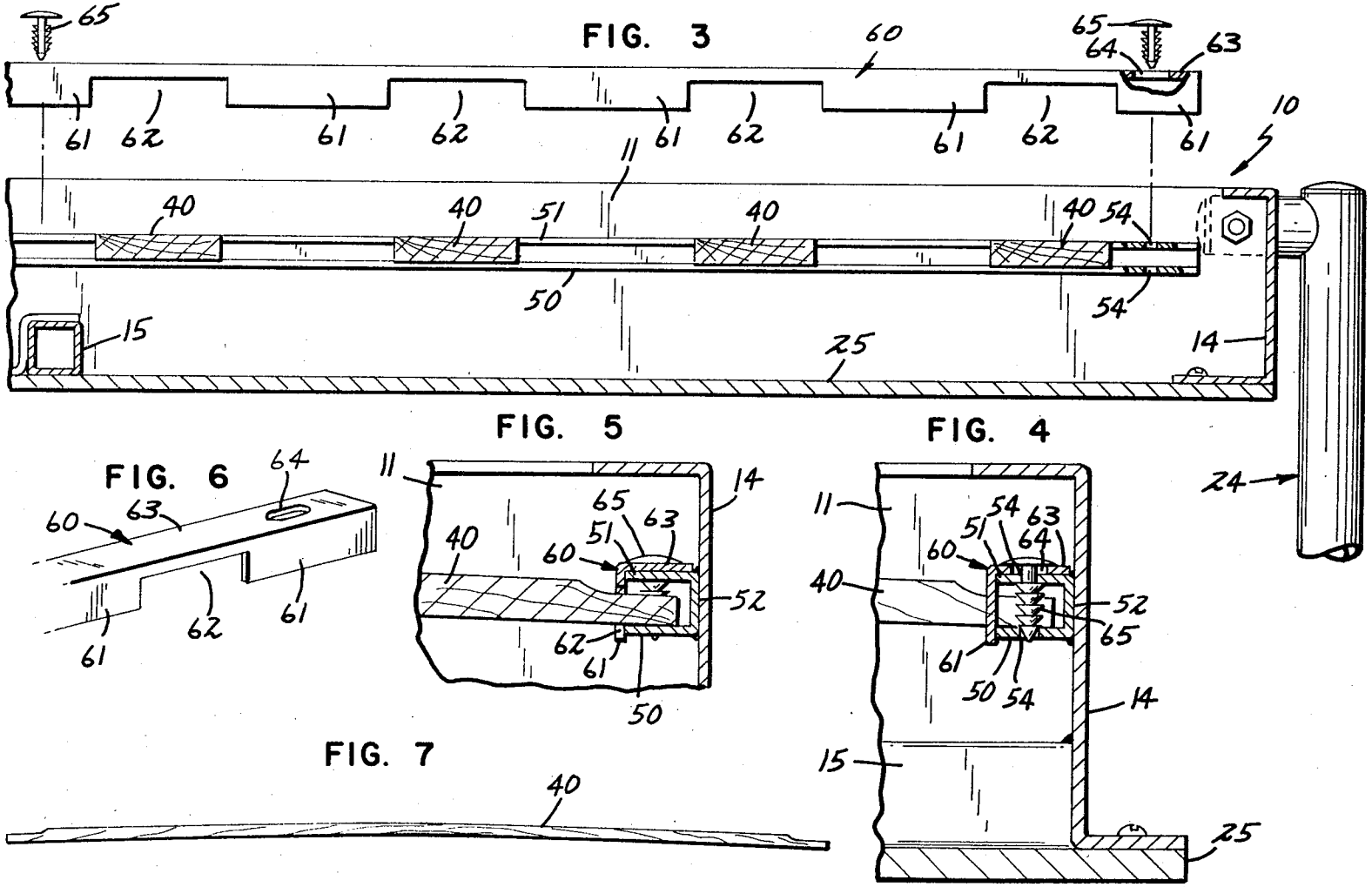
FIG. 3 is a sectional view at an enlarged scale taken generally along line 3—3 of FIG. 1.
FIG. 4 is a sectional view at an enlarged scale taken generally along line 4—4 of FIG. 1.
FIG. 5 is a sectional view at an enlarged scale taken generally along line 5—5 of FIG. 1.
FIG. 6 is a detail of a spacer strip used with the embodiment of FIG. 1.
FIG. 7 is a view of a slat used in the embodiment of FIG. 1.

For supporting the mattress a plurality of bed slats 40 are provided. The slats are narrow elongate strips which extend from side to side of the bed transversely to the longitudinal axis thereof. Specifically, the slats 40 have a length corresponding to the inside dimension between side frame members 11 and 12. The slats can be made of wood, metal, plastic or other materials, and in the preferred embodiment are made of wood with a slight upwardly convex bow to provide a spring effect as seen in FIG. 7. Also, the ends of the slat are of slightly reduced thickness in the preferred embodiment, although this is not necessary for the invention.

The slat holding and securing features of the present invention are seen primarily in FIGS. 2–6. The ends of the slats 40 are supported by flanges 50 which extend outwardly from the inside surface of each of side frame members 11, 12, extending substantially along the length thereof. Although not essential to the invention, the preferred embodiment shown in the drawings uses a second flange 51 on each side frame member, spaced apart from flange 50 to define a slot therebetween which receives the ends of slats 40. In the preferred embodiment, flanges 50 and 51 are leg-portions of a U-sectioned channel, whose base portion 52 is in abutment with the side frame member and is welded thereto.

The U-sectioned channels defining flanges 50 and 51 extend substantially the length of the bed. In the embodiment shown, in order to provide clearance for the hinge counterbalance mechanisms 22, 23, separate U-channel strips 50*a*, 51*a* are mounted slightly inwardly and shorter slats 40*a* are used in the hinge area in order to provide the necessary clearance.

The parallel flanges with the slot therebetween receiving the slot ends thus provides support for the slats for bearing the weight of the mattress and the occupant of the bed, and specifically they provide support in the up and down direction with reference to the bed in its usable position. However, they do not provide lateral spacing or location of the slats. For that purpose spacer strips 60 are provided. Spacer strips 60 comprise a strip having alternate tab portions 61 and space portions 62. Each spacer strip 60 is adapted to be placed in a vertical orientation with the tab portions 61 extending across flange portions 50 and 51 and the slot formed therebetween with the space portions 62 receiving the slats 40. In this manner the slats are held in the spaces 62 and separated from one another by tab portions 61.

In the preferred embodiment spacer strip 60 is formed from an L-sectioned strip, preferably an extrusion, so that it has a base portion indicated by reference number 63 which is at right angles to the tab portions 61. The base portion is adapted to fit on top of flange 51 while the tab portions extend down across the flanges and between the slats 40 as previously described. Holes 64 are provided at suitable intervals in base portion 63 of the spacer strip, and corresponding holes 54 are provided in flanges 51 and possibly 50 also, to receive fasteners 65 to secure the spacer strip to the flanges. For convenience hole 64 can be an elongate slot to simplify alignment during assembly, and fastener 65 can be a plastic barbed panel fastener which requires only snapping into place for ease of assembly.

Spacer strips 60 can be long to run substantially the full length of the bed, or two or more shorter sections can be provided as desired. Also, in the embodiment of FIG. 1, shorter sections indicated by reference number 60*b* can be provided for the closer spaced slat holder sections in the hinge area.

In FIG. 1 spacer strip 60 is shown assembled on the flanges on side frame member 11, and similarly the shorter spacer strip 60*b* is shown assembled on the flanges 50*a*, 51*a* mounted on the hinge-counterbalance assembly 22 on that side. On the opposite side of the bed, along side frame member 12 and hinge counterbalance mechanism 23, for purpose of illustration the spacer strips 60 and 60*b* are shown lying across the slats but not yet moved to position and secured. For ease of assembly the slats can be approximately positioned under a spacer strip which is then slid outwardly of the bed to its position on the flange 51, after which the fasteners 65 can be inserted.

With the ends of the slats 40 secured between flanges 50, 51 along the sides of the frame, and with the spacer strips 60 secured in place with tab portions 61 separating the slats, all slats will be properly spaced and secured so that they will not move regardless of whether the bed is in the horizontal use position or the vertical storage position.

Even though the slats are held securely in place, it is very simple to remove or replace them in the field if that ever becomes necessary. Fasteners 65 for one of the strips can be popped out, allowing removal of the spacer strip and removal and replacement of one or more slats, after which the spacer strip and fasteners are simply snapped back into place.

Although the preferred embodiment shows spacer strips 60 fitting on the upper flanges and extending down across the slot between the flanges, the opposite is equally possible, in which case the spacer strips would be secured to flanges 50 with the tabs projecting upwardly across the slot between adjacent slats.

For embodiments which do not use the upper flange 51 on each side frame member, the spacer strips 60 can perform the dual functions of spacing the slats and holding them down in position on flange 50. If flange 51 is deleted, other means may be provided for securing spacer strips 60, for example spaced brackets positioned along the side frame members so that the spacer strips can be secured thereto with fastener 65 or equivalents in substantially the same manner as illustrated in the preferred embodiment. Alternatively, further tabs or brackets can be provided at intervals on spacer strips 60 for attachment to the side frame members.

It will thus be seen that the bed frame support structure of the present invention provides a simple but very secure spacer and holder for the mattress support slats, that is economical to manufacture, simple to install or service, and is very effective in holding the slats in place.

I claim:

1. A bed frame, comprising:

a support frame including a pair of spaced apart parallel side frame members;

a plurality of bed slats having a length for fitting between the side frame members to support a mattress thereon;

each of said side frame members having a U-sectioned slat holder strip having a base portion secured adjacent the side frame members and with the leg-portions of the strip projecting inwardly of the bed frame and spaced apart to define a slot for receiving the ends of the slats therebetween;

L-sectioned spacer strips for said slat holders, each of said spacer strips having a base portion for mounting in abutment with a leg portion of said U-sectioned slat holders, and having a plurality of spaced tab portions at an angle thereto separated by recess portions sized according to the width of the slat ends; and separable fastener means for attaching said spacer strips to said slat holders with said tab portions between adjacent slats to thereby space them from one another.

2. A bed frame, comprising:

a generally rectangular support frame including a pair of spaced apart side members and a pair of spaced apart end members, said side members being generally longer than said end members;

each of said side frame members having a U-sectioned channel member attached, said channel member including a base and leg portions wherein the base of said channel member is secured adjacent said side frame member with the leg portions projecting inwardly of the bed frame to define a slot for receiving ends of bed slats;

a plurality of bed slats for extending transversely of the bed with ends positioned in said slots defined by said U-sectioned channel members;

L-sectioned spacer strips for said channel members, each of said spacer strips having a base portion for attaching in abutment with one of the leg portions of said channel members, and having a plurality of tab portions at an angle thereto separated by spaces which correspond to the width of the slat ends; and removable fastener means for attaching said L-sectioned spacer strips to said U-sectioned channel members, said base portion of the spacer strip being secured in abutment with one of the leg portions of the U-sectioned channel member and the tab portions of the spacer strip extending across said slot defined by the legs of the U-sectioned channel with said space portions receiving the slats so as to secure the slats in a spaced relationship along the length of the bed.

3. A bed frame according to claim 2 wherein said removable fastener means included first openings in the base portion of said spacer strips at suitable intervals therealong and corresponding second openings in one of the legs of said channel members, said fastener means further including barbed panel fasteners, positioned through said first and second openings to fasten said strips to said channel members.

* * * * *